US005734139A

United States Patent [19]

Hügin

[11] Patent Number: 5,734,139

[45] Date of Patent: Mar. 31, 1998

[54] SHUT-OFF DEVICE FOR A DRIVEN SHAFT

[76] Inventor: Walter Hügin, Dammstr. 5, 79588 Efringen-Kirchen, Germany

[21] Appl. No.: 775,076

[22] Filed: Dec. 27, 1996

[30] Foreign Application Priority Data

Dec. 27, 1995 [DE] Germany ..... 195 48 849.0

[51] Int. Cl.[6] ..... H01H 3/16

[52] U.S. Cl. ..... 200/33 R; 200/30 R

[58] Field of Search ..... 200/11 R–11 TC, 200/19 R, 21, 19 A, 28, 30 R, 33 R, 35 R, 36, 38 R, 38 B, 38 C, 38 D, 38 DA, 38 DB, 38 DC, 39 R, 40, 33 B, 501

[56] References Cited

U.S. PATENT DOCUMENTS

| | | | |
|---|---|---|---|
| 2,913,544 | 11/1959 | Goddard | 200/35 |
| 3,001,418 | 9/1961 | Nectoux | 74/568 |
| 3,499,127 | 3/1970 | Cherry et al. | 200/17 |
| 3,575,579 | 4/1971 | McGannon | 200/19 |
| 3,937,910 | 2/1976 | Fukami | 200/35 R |
| 4,121,064 | 10/1978 | Nakajima et al. | 200/19 A |
| 4,322,589 | 3/1982 | Pommat et al. | 200/30 R |
| 4,412,750 | 11/1983 | Schuder et al. | 368/98 |

*Primary Examiner*—Michael L. Gellner
*Assistant Examiner*—Michael A. Friedhofer
*Attorney, Agent, or Firm*—Kenyon & Kenyon

[57] ABSTRACT

A device for shutting off the rotary movement of a shaft driven by an electric motor via a reducing gear, after an adjustably predetermined number of revolutions, particularly a shaft for activating a window covering such as a blind with individual slats, with several ring-shaped switching disks arranged next to one another in their axial direction, each having a notch on its outside, which disks can be rotated about their common axis when the shaft is driven, with a rocker switch pressed against the switching disks by a spring and resting against the outside of the disks, which rocker shuts off the drive of the shaft when it simultaneously drops into the notches of all the switching disks, and on the inside of which disks inside gear teeth are provided, with the number of teeth being different from the number of teeth of the other switching disks in each instance, where the switching disks can be driven on their inside gear teeth by means of a gear wheel driven by the shaft, where the gear wheel is arranged coaxially on the shaft, so as not to rotate on it, and is directly engaged with the inside gear teeth of the switching disks during operation, where the outside diameter of the gear wheel is smaller than the inside diameter of the switching disks by at least twice the gear tooth height, and where the switching disks are arranged so that they can be shifted radially relative to the gear wheel.

10 Claims, 2 Drawing Sheets

SHUT-OFF DEVICE FOR A DRIVEN SHAFT

BACKGROUND OF THE INVENTION

The invention relates to a device for shutting off the rotary movement of a shaft driven by an electric motor via a reducing gear, after an adjustably predetermined number of revolutions, particularly a shaft for activating a window covering such as a blind with individual slats, with several ring-shaped switching disks arranged next to one another in their axial direction, each having a notch on its outside (i.e., on the outside circumference surface), which disks can be rotated about their common axis when the shaft is driven, with a rocker switch pressed against the switching disks by a spring and resting against the outside of the disks, which rocker shuts off the drive of the shaft when it simultaneously drops into the notches of all the switching disks, and on the inside (i.e. on the inside circumference) of which disks inside gear teeth are provided, with the number of teeth being different from the number of teeth of the other switching disks in each instance, where the switching disks can be driven on their inside gear teeth by means of a gear wheel driven by the shaft.

Such shut-off devices are needed in various fields of technology (for example for stepper drives in systems construction), in order to automatically shut off the rotary movement of a driven shaft after a predetermined number of revolutions. This is necessary, for example, if the shaft serves to activate (i.e., open and close) a window blind with individual slats. In this connection, the shaft has to be stopped in the end positions of the window covering (i.e. its completely open or closed position), since otherwise damage to the window covering could occur. This can be achieved, in simple manner, in that the power supply to the drive motor is interrupted in response to a signal generated in the end position in each instance, or directly via a switch activated in the end position.

For this purpose, such shut-off devices frequently utilize so-called switching or control disks, which are provided with a notch on their outside circumference surface in each instance, where the notches of all the switching disks are axially aligned with one another in their shut-off end position in each instance, so that a rocker switch pressed against the switching disks by the force of a spring can drop into the notches and thereby activate a switch which interrupts the power supply to the drive motor, so that the latter can then only rotate the shaft in the opposite direction of rotation. However, the notches of the switching disks then become misaligned in the axial direction, i.e. they are rotated around the axis of the switching disk by different amounts, relative to one another, because the switching disks are driven at a (slightly) different translation in each instance, proceeding from the shaft. This has the consequence that the rocker switch is pressed radially outward at its lever which engages with the switching disks, counter to the force of the spring acting on it, and can act on a switch with its other lever, which switch produces the power connection with the drive motor, so that if reversing occurs again, the shaft can be driven until the set end position has again been reached. In this end position, the notches of the switching disks again align axially with one another, so that the rocker switch can drop in and the power supply to the drive motor is interrupted. In this connection, such an end shut-off is generally provided for both directions of rotation of the shaft.

However, the number of revolutions of the shaft which the shaft must perform between the two end positions differs for one and the same drive and for different cases of use. When used for a blind with individual slats, it is obviously dependent on the length of the window covering. This has the consequence that the shut-off end positions must each be adjusted individually during installation of a system.

In a shut-off device known from DE-OS 24 26 719, the switching disks are driven by the driven shaft, via a reducing gear and a differential gear. In this connection, the reducing gear is a reversing, multi-stage planetary gear which drives a central gear wheel of the differential gear at a stepped-down number of rotations as compared with the shaft, and the differential gear consists of gear wheels with different numbers of teeth, which are arranged coaxially next to one another and engage in the central gear wheel formed by the drive pinion of the planetary gear. These gear wheels are each provided with hollow shaft stumps which engage in one another coaxially, and on which the switching disks are seated in each instance. In this connection, the switching disks are each divided into a hub which is fixed on the hollow shaft stump in each instance, and an outer ring which can be rotated and engaged with this hub, where the switching disks are adjusted by turning this ring relative to the hubs.

In this known shut-off device, it is true that adjusting the switching disks in their end position by turning the outer ring is relatively easy to do, but it can only be done in steps, corresponding to the prior engagement steps. In addition, because of the resilient engagement between the outer ring and the hub, it is not ensured that the setting made will be reliably maintained after an extended time of operation. The most significant disadvantage, however, lies in the relatively complicated and therefore expensive structure which hollow shaft stumps concentrically engaged inside one another, among other things, and multi-part engaging switching disks require, with the corresponding effort for production and assembly, and which overall results in a significant construction size.

In order to reduce the latter, particularly with regard to its axial length, a device of the type described initially has become known from DE 27 14 021C2, in which the central gear wheel, which drives the switching disks via the gear wheels with different numbers of teeth that are assigned to them in each instance, is surrounded by sleeve-shaped pinion cages which follow each other axially and are held so as not to rotate, with the number of these cages corresponding to the number of switching disks, where at least one planetary gear wheel engaging with the central gear wheel is mounted on each pinion cage, and the gear wheels with different numbers of teeth are formed by inside gear teeth of the switching disks mounted to rotate on the outside circumference of the pinion cages, which engage with the planetary gear wheels in each instance. In this connection, the shaft axis runs parallel to the axis of the central gear wheel, which is structured as a gear shaft and can be shifted axially, on which a gear wheel is fixed so as not to rotate, which gear wheel, in operation, engages with a gear wheel fixed on the shaft so as not to rotate, and can be brought out of engagement with the gear wheel arranged on the shaft, in order to adjust the switching disks, by axially shifting the central gear wheel, so that the switching disks—independent of the drive—can be rotated by means of a setting button arranged on the end of the central gear wheel, until the position in which their notches are axially aligned is reached, so that the rocker switch can drop into the notches.

In practice, pre-adjustment is performed in the plant in such a way that the switching disks reach this switching position after only a few revolutions of the shaft, and the drive is therefore shut down. Then the setting button is pressed in, while simultaneously uncoupling the central gear wheel from the shaft, and [the switching disks are] rotated until the rocker switch is lifted out of the notches, so that the drive begins to run again, without the switching disks being driven. When the pre-switched device (i.e. the window blind, for example) reaches the desired shut-off position, the switching disks are rotated, using the setting button, back into the position in which the rocker switch can drop into their aligned notches, so that the switch which can be activated by the rocker switch is activated and the drive is shut off. Then the central gear wheel is moved back axially into its initial position, by pulling on the setting button connected with it, in which position the gear wheel fixed on it so as not to rotate is again engaged with the gear wheel fixed on the shaft so as not to rotate, in other words the rotary drive connection has been restored, where also a locking element is activated, in order to prevent unintentional axial shifting of the central gear wheel during operation.

It is true that this known shut-off device requires a significantly lesser construction length as compared with the one described previously, but with regard to its structure and the adjustment of the shut-off positions, in particular, it is still very complicated and therefore requires a corresponding effort for production and assembly.

SUMMARY OF THE INVENTION

The present invention is based on the task of simplifying the shut-off device of the type stated, and particularly of improving it in such a way that the adjustment of the desired shut-off position(s) in each instance can be performed very simply and therefore quickly, while at the same time a low construction height is to be made possible.

This task is accomplished, according to the invention, in that the gear wheel by means of which the switching disks are driven at their inside gear teeth is arranged coaxially on the shaft, so as not to rotate on it, or is formed as part of it, and is directly engaged with the inside gear teeth of the switching disks during operation, in other words that the gear wheel passes through the switching disks, where the outside diameter of the gear wheel is smaller than the inside diameter of the switching disks by at least twice the gear tooth height, and where the switching disks are arranged in the device housing so that they can be shifted radially relative to the gear wheel, i.e. relative to the shaft.

Because of the measure that the gear wheel driven by the shaft, by means of which the switching disks can be driven on their inside gear teeth, engages directly with the inside gear teeth of the switching disks, a very compact method of construction can already be achieved, where such an arrangement is made possible by the fact that the outside diameter of the gear wheel is made to be smaller than the inside diameter of the switching disks, so that the gear wheel does not engage with the inside gear teeth of the switching disks on its entire circumference during operation, specifically so much smaller that the switching disks can be brought out of engagement with the gear wheel in case of a radial shift relative to the latter when an adjustment of the shut-off position is to be made, as this will be described in greater detail below.

The switching disks are preferably mounted in a cage-like switching disk housing on the outside, so as to rotate about their axis relative to one another, which housing can be shifted radially to the switching disks from an operating position, in the direction towards the rocker switch relative to the device housing, in order to be able to shift them together, relative to the shaft, i.e. the gear wheel affixed on it so as not to rotate or formed on it, when the shut-off is being adjusted, where it is practical if the switching disks are mounted in the switching disk housing so as not to move axially.

The switching disk housing is preferably structured in such a way that it surrounds the switching disks on their side opposite the rocker switch—and it is practical if this is on more than half their outside—with a positive lock, and is provided with a recess in the region of the rocker switch, in which it is possible for the rocker switch to rest against the outside of the switching disks.

In order to guarantee a defined relative shift between the switching disks and the gear wheel during adjustment of the shut-off, the switching disk housing is preferably provided with guide surfaces on its outside, which interact with guide surfaces of the device housing, where the ability to shift the switching disk housing can be limited by stops which ensure that the gear wheel is out of engagement with the inside gear teeth of the switching disks when the greatest displacement path has been reached, and which prevent it from engaging with the inside gear teeth of the switching rings at its segment which lies opposite its engagement segment.

DETAILED DESCRIPTION

The invention will be explained below on the basis of an exemplary embodiment, making reference to a drawings.

Figure 1:
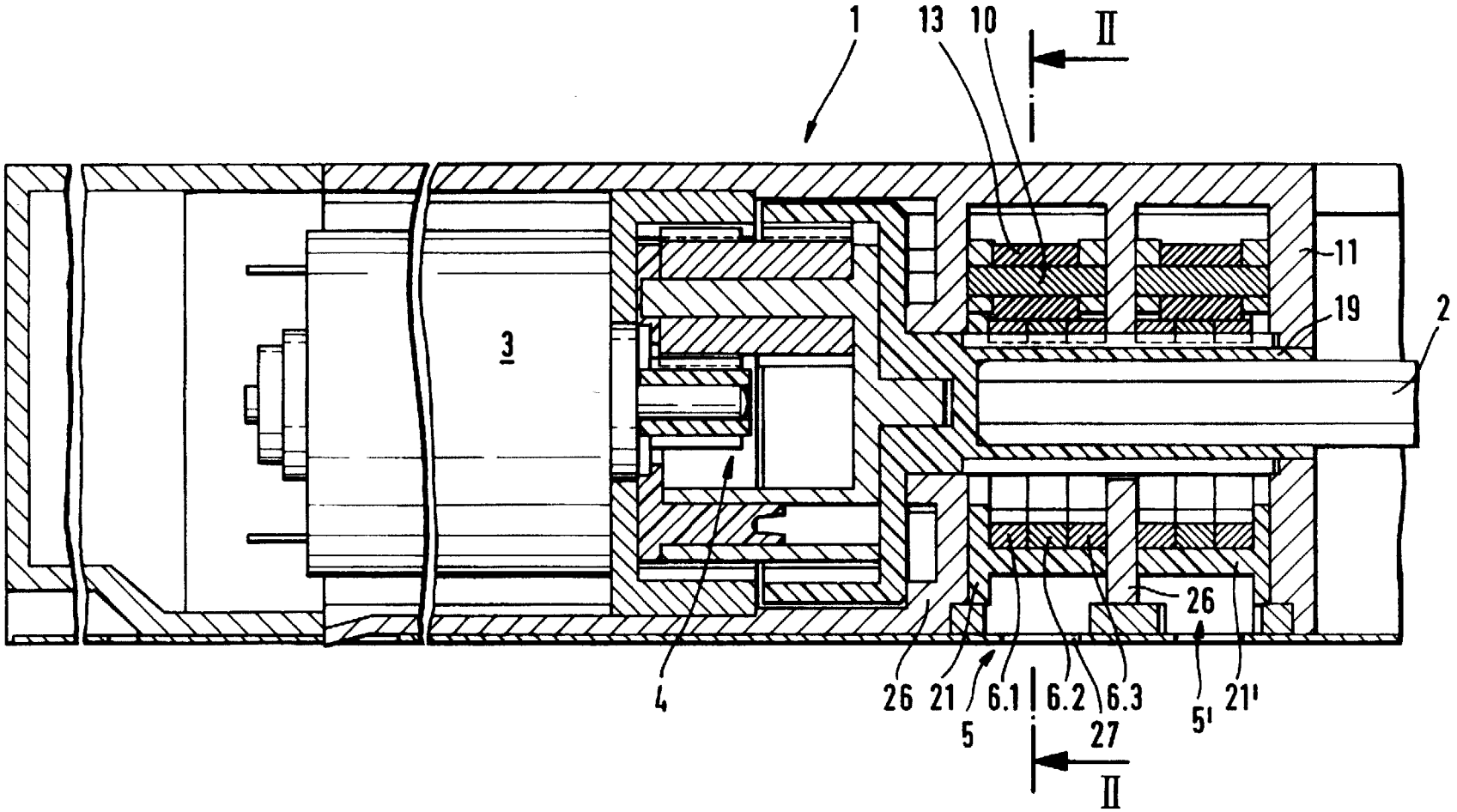
FIG. 1 is a longitudinal cross-section through a head rail of a blind with horizontal slats, which can be activated with an electric motor, containing the drive, the shut-off device and the drive shaft, viewed in the direction of the cross-sectional line I—I in FIG. 2.

FIG. 1 shows a head rail, designated as a whole as 1, of a blind with horizontal slats, the window covering of which, not shown, can be activated, in other words moved out of its open position into its closed position (and vice versa) by means of a shaft 2. To drive the horizontal shaft 2, a reversible electric motor 3 is provided, which drives the shaft 2 via a reducing gear designated as a whole as 4, structured as a planetary gear. In addition, there are two shut-off devices indicated as a whole as 5 and 5', respectively, present in the head rail, by means of which the rotary movement of the shaft 2 can be shut off after an adjustably predetermined number of revolutions in each instance, when the window covering, not shown, has reached its open or closed position. The shut-off devices in 5, 5' are structured the same way, so that it is sufficient to describe them on the basis of the one shut-off device 5 in the following.

The shut-off device 5 has three ring-shaped switching disks 6.1, 6.2, and 6.3, arranged next to one another in their axial direction, which are each provided with an axially continuous notch 8 on their cylindrical outside. Adjacent to the switching disks 6, a rocker switch indicated as a whole as 9 is arranged, which is mounted in the device housing 11 to pivot on a pivot axis 10, which runs parallel to the shaft 2. The one arm 12 of the rocker switch 9 rests against the outside 7 of the switching disks 6 with a roller 13 which is mounted to rotate, under the pressure of a spring 14, which acts on the end segment 12' of the arm 12 and is supported on the device housing 11 at its other end. The other arm 15 of the rocker switch 9 is out of engagement with a switch 16 (see FIG. 2) when the roller 13 is located in the axially aligned notches 8 of the switching disks 6.1, 6.2, and 6.3, where the power supply to the motor 3 is interrupted in this position. If, however, at least two of the switching disks 6 are rotated out of alignment relative to one another, around their axis 17, the roller 13 is lifted sufficiently so that it rests against the cylindrical circumference segment of the switching disks 6, causing the arm 15 of the rocker switch 9 to activate the switch 16, with the consequence that voltage is applied to the electric motor 3 and it drives the shaft 2.

The switching disks are each provided with inside gear teeth 18 on their inside circumference surface, with the number of teeth being different, in each instance, from the number of teeth of the other switching disks. In the exemplary embodiment shown, the number of teeth of the switching disk 6.1 is 25, that of the switching disk 6.2 is 28, and that of the switching disk 6.3 is 26. The number of gear teeth is therefore only slightly different, so that the inside gear teeth 18.1, 18.2, and 18.3 can interact with a gear wheel 19 which is arranged coaxially and so as not to rotate on the shaft 2, and engages directly with the inside gear teeth 18.1, 18.2, and 18.3 of the switching disks 6.1, 6.2, and 6.3.

As is particularly evident from FIG. 2, the outside diameter d of the gear wheel 19 is smaller than the inside diameter D of the switching disks 6.1, 6.2, and 6.3, specifically by at least twice the tooth height of the gear wheel 19 or the inside gear teeth 18 of the switching disks 6, so that the switching disks 6 can be brought out of engagement with the gear wheel 19, as will be described in greater detail below. For this purpose, the switching disks 6.1, 6.2, and 6.3 are arranged so that they can be shifted radially in the device housing, in the direction of the arrow 20, relative to the gear wheel 19.

In order to be able to implement simple, simultaneous shifting, and in order to hold the switching disks in the device housing 11 in particularly simple and therefore practical manner, all the switching disks 6.1, 6.2, and 6.3 are mounted in a cage-like switching disk housing 21 on the outside 7, so as to rotate about their axis 17 relative to one another, which housing can be shifted radially to the switching disks 6.1, 6.2, and 6.3 from its operating position shown in the drawing, in the direction of the arrow 20, towards the rocker switch 9, relative to the device housing 11. For this purpose, the switching disk housing 21 is provided with guide surfaces 22 on its outside, which interact with guide surfaces 23 of the device housing 11, where the ability to shift the switching disk housing 21 is limited by stops 24 which are arranged in such a way that the gear wheel 19 is out of engagement with the inside gear teeth 18 of the switching disks 6 at the greatest displacement path.

Figure 2:
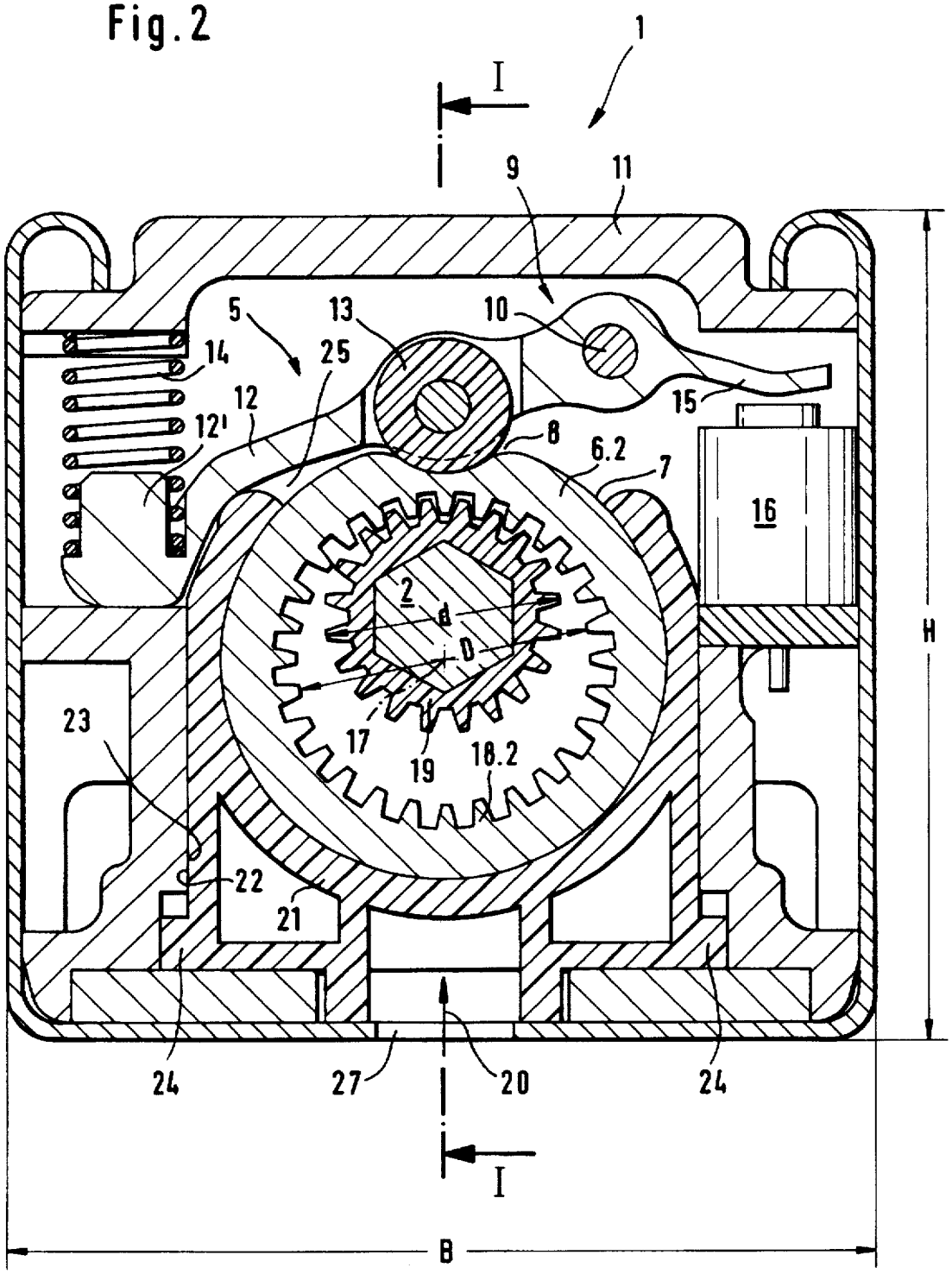
FIG. 2 is an enlarged cross-sectional view of the representation according to FIG. 1, viewed in the direction of the cross-sectional line II—II.

As is evident from FIG. 2, the switching disk housing 21 surrounds the switching disks 6.1, 6.2, and 6.3 on more than half of their outside, and has a recess 25 in the region of the rocker switch 9, so that the roller 13 of the rocker switch 9 can engage with the switching disks 6. Furthermore, the switching disks 6.1, 6.2, and 6.3 are mounted in the switching disk housing 21 in axially immovable manner, without any other connection, immediately adjacent to one another axially, where the outer switching disks 6.1 and 6.3 rest against a radial wall of the switching disk housing 21 and the device housing 11, respectively.

The switching disk housing 21 is accessible from the outside at its segment which lies opposite the rocker switch 9. For this purpose, the device housing 11 is provided with a passage opening 27.

It should also be pointed out that the reducing gear 4 arranged between the electric motor 3 and the shaft 2 is a known, self-inhibiting tungsten planetary gear, which only rotates when it is activated by the motor, but not when it is activated by the shaft.

On the basis of the structure according to the invention, the width B and the height H of the head rail 1 can be kept as small as the space required by the electric motor 3, approximately 30 mm in each instance, since the shut-off devices 5, 5' can easily be housed in such a head rail 1, i.e. a corresponding device housing 11.

However, the shut-off device according to the invention is not only structured in very simple, space-saving manner, but also allows particularly simple adjustment of the shut-off, particularly because rotation of the switching disks 6 relative to one another is not required.

If the shut-off devices 5 and 5' are adjusted in the plant in such a way that the notches 8 of the switching disks 6.1, 6.2, and 6.3 are axially aligned with one another, so that the roller 13 of the rocker switch 9 can drop into them and the switch 16 therefore interrupts the power supply to the motor 3, it is only necessary to insert a tool such as a screwdriver, wrench, or a similar tool into the opening 27, in order to shift the switching disk housing 21 in the direction of the arrow 20, taking along the switching disks 6.1, 6.2, and 6.3, against the force exerted by the spring 14, in the direction of the rocker switch 9, until the stops 24 go into effect. In this connection, the rocker switch 9 is pivoted about its axis 10, so that its arm 15 activates the switch 16 and the motor 3, which is switched on, has power applied to it, so that it turns the shaft 2. In this shifted position, however, the gear wheel 19 is out of engagement with the inside gear teeth 18.1, 18.2, and 18.3 of the switching disks 6.1, 6.2, and 6.3, so that the switching disks are not driven. Once the desired end position of the window covering (for example, its open end position) has been reached, the tool only has to be retracted from the opening 27, so that the spring 14 pivots the rocker 9 back into its starting position, and thereby pushes the switching disk housing 21 back into its operating position.

Adjustment of the other shut-off device 5' takes place in analogous manner. The motor is activated in the opposite direction of rotation, but at first does not turn, because the shut-off device 5' is in the shut-off state. However, if the switching disk housing 21' of the shut-off device 5' is shifted so far in the direction of its rocker 9' that the gear wheel 19 gets out of engagement with the switching disks 6.1', 6.2', and 6.3', the motor 3 has power applied to it via the switch 16', and rotates the shaft 2 until the window covering has reached its other end position, where the switching disks 6.1, 6.2, and 6.3 of the other shut-off device are in engagement with the gear wheel 19, in other words are rotated relative to one another, so that if the drive motor 3 is reversed again, it remains turned on until the end position previously set on the shut-off device 5 is reached again after a corresponding number of revolutions, and the motor is automatically shut off.

What is claimed is:

1. A device for shutting off the rotary movement of a shaft driven by an electric motor via a reducing gear, after an adjustably predetermined number of revolutions, particularly a shaft for activating a window covering, which has several ring-shaped switching disks arranged next to one another in an axial direction, each of the disks having a notch on an outside, the disks can be rotated about a common axis when the shaft is driven, with a rocker switch pressed against the switching disks by a spring and resting against the outside of the disks, the rocker switch shuts off the drive of the shaft when the rocker switch simultaneously drops into the notches of all the switching disks, and on an inside of the disks inside gear teeth are provided, with the number of the teeth of the disks being different from the number of the teeth of the other switching disks, where the switching disks can be driven on the inside gear teeth by means of a gear wheel driven by the shaft, wherein the gear wheel is arranged coaxially on the shaft, so as not to rotate on the shaft, and is directly engaged with the inside gear teeth of the switching disks during operation, where an outside diameter of the gear wheel is smaller than an inside diameter of the switching disks by at least twice the gear teeth height, and where the switching disks can be shifted radially relative to the gear wheel.

2. The device according to claim 1, wherein the switching disks are mounted in a cage-like switching disk housing on the outside, so as to rotate about the axis relative to one another, which housing can be shifted radially to the switching disks from an operating position, towards the rocker switch, relative to a device housing.

3. The device according to claim 2, wherein the switching disks are mounted in the switching disk housing in axially immovable manner.

4. The device according to claim 2, wherein the switching disk housing surrounds the switching disks on a side opposite the rocker switch with a positive lock, and is provided with a recess in the region of the rocker switch.

5. The device according to claim 4, wherein the switching disk housing surrounds the switching disks over more than half the outside.

6. The device according to claim 2, wherein the switching disk housing is provided with guide surfaces on an outside, which interact with guide surfaces of the device housing.

7. The device according claim 2, wherein an ability to shift the switching disk housing is limited by stops.

8. The device according to claim 2, wherein the switching disks are mounted in the switching disk housing immediately adjacent to one another axially, where outer switching disks of the switching disks rest against a radial wall of the switching disk housing and the device housing, respectively.

9. The device according to claim 2, wherein the switching disk housing is accessible from the outside at a segment which lies opposite the rocker switch.

10. The device according to claim 9, wherein the device housing is provided with a passage opening on a side facing away from the rocker switch.

* * * * *